US005832745A

United States Patent [19]

Klein Nagelvoort et al.

[11] Patent Number: 5,832,745

[45] Date of Patent: Nov. 10, 1998

[54] COOLING A FLUID STREAM

[75] Inventors: Robert Klein Nagelvoort; Kornelis Jan Vink; Hilary Ann Mercer, all of The Hague, Netherlands

[73] Assignee: Shell Oil Company, Houston, Tex.

[21] Appl. No.: 930,903

[22] PCT Filed: Apr. 17, 1996

[86] PCT No.: PCT/EP96/01638

§ 371 Date: Jan. 28, 1998

§ 102(e) Date: Jan. 28, 1998

[87] PCT Pub. No.: WO96/33379

PCT Pub. Date: Oct. 24, 1996

[30] Foreign Application Priority Data

Apr. 18, 1995 [EP] European Pat. Off. ..... 95200976.9

[51] Int. Cl.[6] ..... F25J 3/00

[52] U.S. Cl. ..... 62/619; 62/612

[58] Field of Search ..... 62/612, 613, 619, 62/335

[56] References Cited

U.S. PATENT DOCUMENTS 3,898,857 8/1975 Bourguet et al. ..... 62/117
4,251,427 2/1981 Recker et al. ..... 260/37
4,274,849 6/1981 Garier et al. .
4,755,200 7/1988 Liu et al. ..... 62/335 X
4,970,867 11/1990 Herron et al. ..... 62/612
5,613,373 3/1997 Grenier ..... 62/612

*Primary Examiner*—Christopher B. Kilner

[57] ABSTRACT

Method of cooling a fluid stream which passes through a hot side (Id, Ib, Ic) of a main heat exchanger (I) comprising removing refrigerant from the main heat exchanger (I); compressing refrigerant in a two-stage compressor unit (7) to obtain refrigerant at high pressure; partly condensing (12) the refrigerant to obtain a first two-phase fluid, and separating (13) the first two-phase fluid into a first condensed fraction (15) and a first gaseous fraction (16); cooling the first condensed fraction (15) in an auxiliary heat exchanger (2) to obtain a cooled first condensed fraction (18), cooling the first gaseous fraction (16) in the auxiliary heat exchanger (2) to obtain a second two-phase fluid (26), wherein cooling is provided by liquid evaporating at intermediate pressure in the cold side (2*a*); separating (28) the second two-phase fluid into a second condensed fraction (33) and a second gaseous fraction (32); allowing part of the second condensed fraction (49) to evaporate in the cold side (2*a*) of the auxiliary heat exchanger (2); and cooling the remainder of the second condensed fraction (33) in the main heat exchanger (1) to obtain a cooled second condensed fraction, and cooling the second gaseous fraction in the main heat exchanger (1), wherein cooling is provided by liquid evaporating at low pressure in the cold side (1*a*) of the main heat exchanger (1).

19 Claims, 2 Drawing Sheets

COOLING A FLUID STREAM

Figure 1:
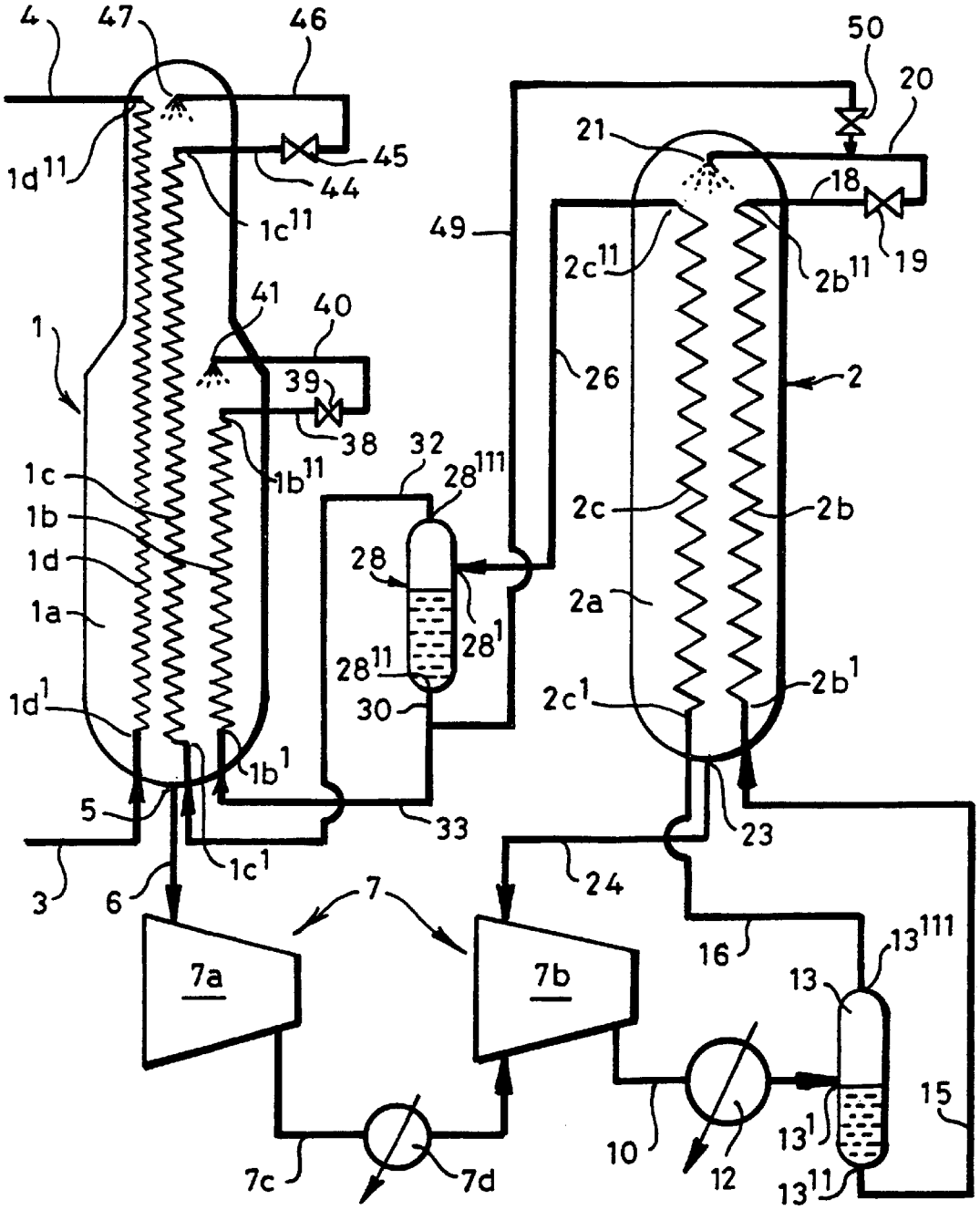

The present invention relates to cooling a fluid stream in indirect contact with an evaporating refrigerant. The fluid stream to be cooled is for example natural gas which is to be liquefied, and the refrigerant is for example a multi-component refrigerant comprising nitrogen, methane, ethane, propane, butanes, and heavier hydrocarbons.

Cooling takes place in a heat exchanger comprising a hot side and a cold side, wherein the hot side and the cold side are in contact with each other so as to allow transfer of heat from the hot side to the cold side of the heat exchanger. The fluid to be cooled passes through the hot side of a heat exchanger and the refrigerant passes through the cold side of the heat exchanger. The heat exchanger can be of any type which is used in cooling and liquefaction of gas, for example a shell and tube type heat exchanger, an extended surface type heat exchanger, a plate-fin type heat exchanger, or a spiral wound type heat exchanger. The fluids can flow counter-currently or cross-currently, and the refrigerant can flow downwards or upwards.

The present invention relates in particular to cooling a fluid stream which passes through a hot side of a main heat exchanger. Such a method of cooling a fluid stream is disclosed in U.S. Pat. No. 4,251,247.

The known method of cooling a fluid stream which passes through a hot side of a main heat exchanger comprises the steps of:

(a) removing refrigerant from the cold side of the main heat exchanger;

(b) compressing refrigerant in a multi-stage compressor unit from a low pressure via at least one intermediate pressure to a high pressure to obtain refrigerant at high pressure;

(c) partly condensing the refrigerant obtained in step (b) to obtain a first two-phase fluid, and separating the first two-phase fluid into a first condensed fraction and a first gaseous fraction;

(d) cooling the first condensed fraction in a first hot side of an auxiliary heat exchanger to obtain a cooled first condensed fraction;

(e) allowing the cooled first condensed fraction to evaporate at an intermediate pressure (P1) in the cold side of the auxiliary heat exchanger to obtain refrigerant at the intermediate pressure (P1) which is subsequently supplied to the inlet of an intermediate stage of the multi-stage compressor unit;

(f) partly condensing the first gaseous fraction in a second hot side of the auxiliary heat exchanger to obtain a second two-phase fluid;

(g) separating the second two-phase fluid into a penultimate condensed fraction and a penultimate gaseous fraction;

(h) cooling penultimate condensed fraction in a first hot side of the main heat exchanger to obtain a cooled penultimate condensed fraction;

(i) allowing cooled penultimate condensed fraction to evaporate at low pressure in the cold side of the main heat exchanger to obtain refrigerant at low pressure which is subsequently supplied to the inlet of the first stage of the multi-stage compressor unit;

(j) cooling the penultimate gaseous fraction in a second hot side of the main heat exchanger to obtain a cooled last condensed fraction; and (k) allowing the cooled last condensed fraction to evaporate at low pressure in the cold side of the main heat exchanger to obtain refrigerant at low pressure which is subsequently supplied to the inlet of the first stage of the multi-stage compressor unit.

In the known method a two-stage compressor unit is used, and the refrigerant at the intermediate pressure (P1) obtained in step (e) is supplied to the inlet of the second stage of a two-stage compressor unit.

The present invention concerns in particular the fluids in the cold side of the main heat exchanger, therefore, before introducing the invention, the compositions and the behaviour of the fluids in the cold side of the main heat exchanger are discussed.

In the known method, heat exchangers of the tube and shell type are used. In this type of heat exchanger the tubes forming the hot sides are arranged in the shell of the heat exchanger, which shell forms the cold side. This type is used in both the main heat exchanger and the auxiliary heat exchanger.

The main heat exchanger consists of two parts. The cold sides of the two parts are connected to form one interconnected cold side, so that the refrigerant at low pressure obtained from evaporating the last condensed fraction in step (j) passes through that part of the cold side of the main heat exchanger in which the cooled penultimate condensed fraction is allowed to evaporate in step (h). The hot side of the main heat exchanger through which the fluid to be cooled is passed comprises two interconnected tubes, each tube being arranged in a cold side of the two-part main heat exchanger.

In the interconnected cold side of the main heat exchanger both the penultimate and the last condensed fractions obtained in step (f) are allowed to evaporate. The evaporating fractions form the refrigerant that is subsequently removed from the main heat exchanger. Evaporation of the components of the fractions takes place according to their vapour-liquid equilibrium ratios at the prevailing pressure and temperature, wherein the vapour-liquid equilibrium ratio (also called K value) is the ratio of the mole fraction of a component in the vapour phase to the mole fraction of that component in the liquid phase at equilibrium. The K value depends on the pressure and temperature, and on the particular component. At a given pressure and temperature nitrogen and methane have relatively high K values, whereas heavier hydrocarbons have relatively low K values, and moreover, at a given temperature the K values increase with decreasing pressure. It is therefore possible to select the pressure in the cold side of the main heat exchanger so that at the prevailing temperature complete evaporation of all components of the penultimate and the last condensed fraction can be achieved. As a result the refrigerant which is removed from the outlet of the cold side of the main heat exchanger is in the gaseous state, and this gaseous refrigerant is supplied to the compressor unit in step (b).

If vaporization is not complete, the refrigerant that is removed from the cold side of the main heat exchanger contains liquid, and thus a liquid-containing fluid is supplied to the compressor unit. Because the presence of liquid in the fluid supplied to the compressor unit adversely affects the performance of the compressor, the pressure in the cold side of the main heat exchanger has to be selected so low that complete evaporation is achieved.

Not only does the pressure in the cold side of the main heat exchanger affect the state of the refrigerant removed from the cold side, the pressure also affects the amount of vapour in the cold side because with decreasing pressure the amount of vapour increases. An increasing amount of vapour results in an increasing volumetric flow rate, and this increasing volumetric flow rate results in an increasing resistance to flow. A larger resistance to flow implies that more work has to be done by the compressor unit to the fluid in order to transport it through the cold side of the main heat exchanger.

To reduce the resistance to flow one could increase the diameter of the cold side, however this can only be done to a limited extent. In stead, one could change the composition of the refrigerant so that it evaporates at a higher pressure, and this can be done in two ways: the overall composition can be adapted so that the refrigerant contains a larger amount of lighter components; or the overall composition of the refrigerant remains as it is, but the composition of the fractions that are supplied to the main heat exchanger is adapted.

Adapting the overall composition of the refrigerant could adversely affect the cooling of the refrigerant in the auxiliary heat exchanger. Therefore Applicant directed his attention to adapting the composition of the fractions that are supplied to the main heat exchanger.

Although the above-mentioned U.S. Pat. No. 4,251,247 does not discuss the problem of limiting the volumetric flow rate in the main heat exchanger, the publication does disclose one way of adapting the composition of the fractions that are supplied to the main heat exchanger. This is done by modifying steps (d), (e) and (f) of the above-described method. The modified steps (d), (e) and (f) comprise:

(d) cooling the first condensed fraction in a first hot side in the lower part of an auxiliary heat exchanger to obtain a cooled first condensed fraction;

(e) allowing the cooled first condensed fraction to evaporate at an intermediate pressure (P1) in the cold side of the lower part of the auxiliary heat exchanger to obtain refrigerant at intermediate pressure (P1) which is subsequently supplied to the inlet of the second stage of the two-stage compressor unit;

($f_1$) cooling the first gaseous fraction in a second hot side in the lower part of the auxiliary heat exchanger to an intermediate temperature to obtain an intermediate two-phase fluid;

($f_2$) separating the intermediate two-phase fluid into an intermediate condensed fraction and an intermediate gaseous fraction;

($f_3$) cooling the intermediate condensed fraction in a third hot side in the upper part of the auxiliary heat exchanger and allowing the cooled intermediate condensed fraction to evaporate in the upper part of the cold side of the auxiliary heat exchanger to obtain refrigerant at intermediate pressure (P1) which is subsequently supplied together with the evaporated first condensed fraction obtained in step (e) to the inlet of the second stage of the two-stage compressor unit; and ($f_4$) cooling the intermediate gaseous fraction in a fourth hot side in the upper part of the auxiliary heat exchanger to obtain the second two-phase fluid.

The modified known process, described above, provides a way of reducing the amount of very heavy hydrocarbons in the second two-phase fluid. However, the second two-phase fluid does still contain an undesirably large amount of hydrocarbons heavier than methane. Moreover, in the known method an additional separator is required for the intermediate separation in step ($f_2$).

The present invention now provides a method of cooling a fluid stream wherein the composition of the fractions which are supplied to the main heat exchanger can be adapted, and wherein no intermediate separation is required.

To this end the method of cooling a fluid stream which passes through a hot side of a main heat exchanger according to the present invention is characterized in that part of the penultimate condensed fraction obtained in step (g) is allowed to evaporate at the intermediate pressure (P1) in the cold side of the auxiliary heat exchanger.

Surprisingly it was found that the properties of the evaporating fluid in the cold side of the auxiliary heat exchanger were not adversely affected by adding part of the second condensed fraction to the first condensed fraction.

An advantage of the present invention is that the low pressure in the cold side of the main heat exchanger can be maintained at a higher level than in the prior art process. Consequently less energy is required to compress the same amount of refrigerant to the high pressure. On the other hand with the same amount of energy more refrigerant can be compressed to the high pressure. When more refrigerant can be compressed the circulation rate can be increased and thus more fluid can be cooled in the main heat exchanger.

The word 'fraction' used in the specification and in the claims also refers to 'portion'.

The present invention further relates to an apparatus for cooling a fluid stream comprising a main heat exchanger provided with a cold side and a hot side through which the fluid stream to be cooled can be passed, an auxiliary heat exchanger provided with a cold side and two hot sides, a multi-stage compressor unit, the outlet of the cold side of the main heat exchanger being connected to the inlet of the first stage and the outlet of the cold side of the auxiliary heat exchanger being connected to the inlet of an intermediate pressure stage, a main gas-liquid separator of which the inlet is connected to a condenser connected to the outlet of the last stage of the multi-stage compressor unit, of which the outlet for liquid is connected to the inlet of a first hot side of the auxiliary heat exchanger and of which the outlet for vapour is connected to the inlet of a second hot side of the auxiliary heat exchanger, a last gas-liquid separator of which the inlet is connected to the outlet of the second hot side of the auxiliary heat exchanger, of which the outlet for liquid is connected to the inlet of a first hot side of the main heat exchanger and of which the outlet for vapour is connected to the inlet of a second hot side of the main heat exchanger, wherein the outlet of the first hot side of the auxiliary heat exchanger is connected to the cold side of the auxiliary heat exchanger by means of a conduit provided with a pressure reduction device, and wherein the outlets of the first hot side and the second hot side of the main heat exchanger are connected the cold side of the main heat exchanger by means of a conduit provided with a pressure reduction device.

Such an apparatus is disclosed in U.S. Pat. No. 4,251,247. In the known method a two-stage compressor unit is used, and the outlet of the auxiliary heat exchanger is connected to the inlet of the second stage of a two-stage compressor unit.

To provide an apparatus for cooling a fluid stream wherein during normal operation the composition of the fractions which are supplied to the main heat exchanger can be adapted, and which apparatus does not require intermediate separation, the apparatus according to the present invention is characterized in that the outlet of the last gas-liquid separator is also connected to the cold side of the auxiliary heat exchanger by means of a conduit provided with a pressure reduction device.

A more complicated method of cooling a fluid stream is disclosed in French patent application publication No. 2 280 042. The method of cooling a fluid stream which passes through a hot side of a main heat exchanger disclosed in this publication comprises the steps of:

(a) removing refrigerant from the cold side of the main heat exchanger;

(b) compressing refrigerant in a two-stage compressor unit from a low pressure via an intermediate pressure to a high pressure to obtain a gaseous refrigerant at high pressure;

(c) partly condensing the gaseous refrigerant obtained in step (b) to obtain a first two-phase fluid, and separating the first two-phase fluid into a first condensed fraction and a first gaseous fraction;

(d) partly condensing the first gaseous fraction in a hot side in the lower part of an auxiliary heat exchanger to obtain a second two-phase fluid, and separating the second two-phase fluid into a second condensed fraction and a second gaseous fraction;

(e) cooling of the first condensed fraction in a first hot side in the lower part of the main heat exchanger to obtain a cooled first condensed fraction;

(f) allowing part of the cooled first condensed fraction to evaporate at low pressure in the cold side of the lower part of the main heat exchanger to obtain refrigerant at low pressure which is subsequently supplied to the inlet of the first stage of the compressor unit, and allowing the remainder of the cooled first condensed fraction to evaporate at intermediate pressure in the cold side of the lower part of the auxiliary heat exchanger to obtain refrigerant at intermediate pressure which is subsequently supplied to the inlet of the second stage of the compressor unit;

(g) cooling part of the second condensed fraction in a second hot side in the upper part of the auxiliary heat exchanger to obtain a cooled second condensed fraction, and allowing the cooled second condensed fraction to evaporate at intermediate pressure in the cold side of the upper part of the auxiliary heat exchanger to obtain refrigerant at intermediate pressure which is subsequently supplied via the lower part of the auxiliary heat exchanger to the inlet of the second stage of the compressor unit;

(h) and cooling the remainder of the second condensed fraction in a second hot side in the middle part of the main heat exchanger to obtain a cooled third condensed fraction, and allowing the cooled third condensed fraction to evaporate at low pressure in the cold side of the middle part of the main heat exchanger to obtain refrigerant at low pressure which is subsequently supplied via the lower part of the main heat exchanger to the inlet of the first stage of the compressor unit;

(i) cooling the second gaseous fraction in a third hot side in the upper part of the auxiliary heat exchanger to obtain a forth condensed fraction;

(j) allowing part of the forth condensed fraction to evaporate at intermediate pressure in the cold side of the upper part of the auxiliary heat exchanger to obtain refrigerant at intermediate pressure which is subsequently supplied via the lower part of the auxiliary heat exchanger to the inlet of the second stage of the compressor unit;

(k) cooling the remainder of the forth condensed fraction in a third hot side in the upper part of the main heat exchanger to obtain a cooled forth condensed fraction; and (l) allowing the cooled forth condensed fraction to evaporate at low pressure in the cold side of the upper part of the main heat exchanger to obtain refrigerant at low pressure which is subsequently supplied via the middle part and lower part of the main heat exchanger to the inlet of the first stage of the compressor unit.

Not only does this latter publication describes a complicated method, but the publication also points away from the present invention because it discloses in step (f) allowing evaporation at low pressure of the first condensed fraction in the cold side of the lower part of the main heat exchanger. Since the first condensed fraction contains the heaviest hydrocarbons, this implies that the pressure in the cold side of the main heat exchanger has to be selected very low to achieve complete evaporation of this fraction. And as discussed, such a low pressure results in large volumetric flow rates and consequently large pressure drops.

Reference is further made to French patent application publication No. 2 292 203. This publication shows in FIG. 5 a method of cooling a fluid stream which passes through a hot side of a main heat exchanger, which method comprises the steps of:

(a) removing refrigerant from the cold side of the main heat exchanger;

(b) compressing refrigerant in a two-stage compressor unit from a low pressure via an intermediate pressure to a high pressure to obtain refrigerant at high pressure;

(c) partly condensing the refrigerant obtained in step (b) to obtain a first two-phase fluid;

(d) further cooling the first two-phase fluid in a hot side of an auxiliary heat exchanger to obtain a cooled first two-phase fluid, and separating the cooled first two-phase fluid into a first condensed fraction and a first gaseous fraction;

(e) allowing part of the first condensed fraction to evaporate at an intermediate pressure in the cold side of the auxiliary heat exchanger to obtain refrigerant at intermediate pressure which is subsequently supplied to the inlet of the second stage of the two-stage compressor unit;

(f) cooling the remainder of the first condensed fraction in a first hot side of the main heat exchanger to obtain a cooled first condensed fraction;

(g) allowing cooled first condensed fraction to evaporate at low pressure in the cold side of the main heat exchanger to obtain refrigerant at low pressure which is subsequently supplied to the inlet of the first stage of the two-stage compressor unit;

(h) cooling the first gaseous fraction in a second hot side of the main heat exchanger to obtain a cooled second condensed fraction; and (i) allowing the cooled second condensed fraction to evaporate at low pressure in the cold side of the main heat exchanger to obtain refrigerant at low pressure which is subsequently supplied to the inlet of the first stage of the two-stage compressor unit.

This publication discloses that (1) there is no separation of the first two-phase fluid upstream of the auxiliary heat exchanger; and (2) the first gaseous fraction is not condensed in the auxiliary heat exchanger.

This publication discloses a method which is similar to the method disclosed in the above-discussed U.S. Pat. No. 4,251,247, in that the first two-phase fluid consisting of the first gaseous fraction and the first liquid fraction is further cooled in step (d), after which part of the first condensed fraction is used as evaporating fluid in step (e). Therefore this publication is not relevant to the present invention.

Figure 2:
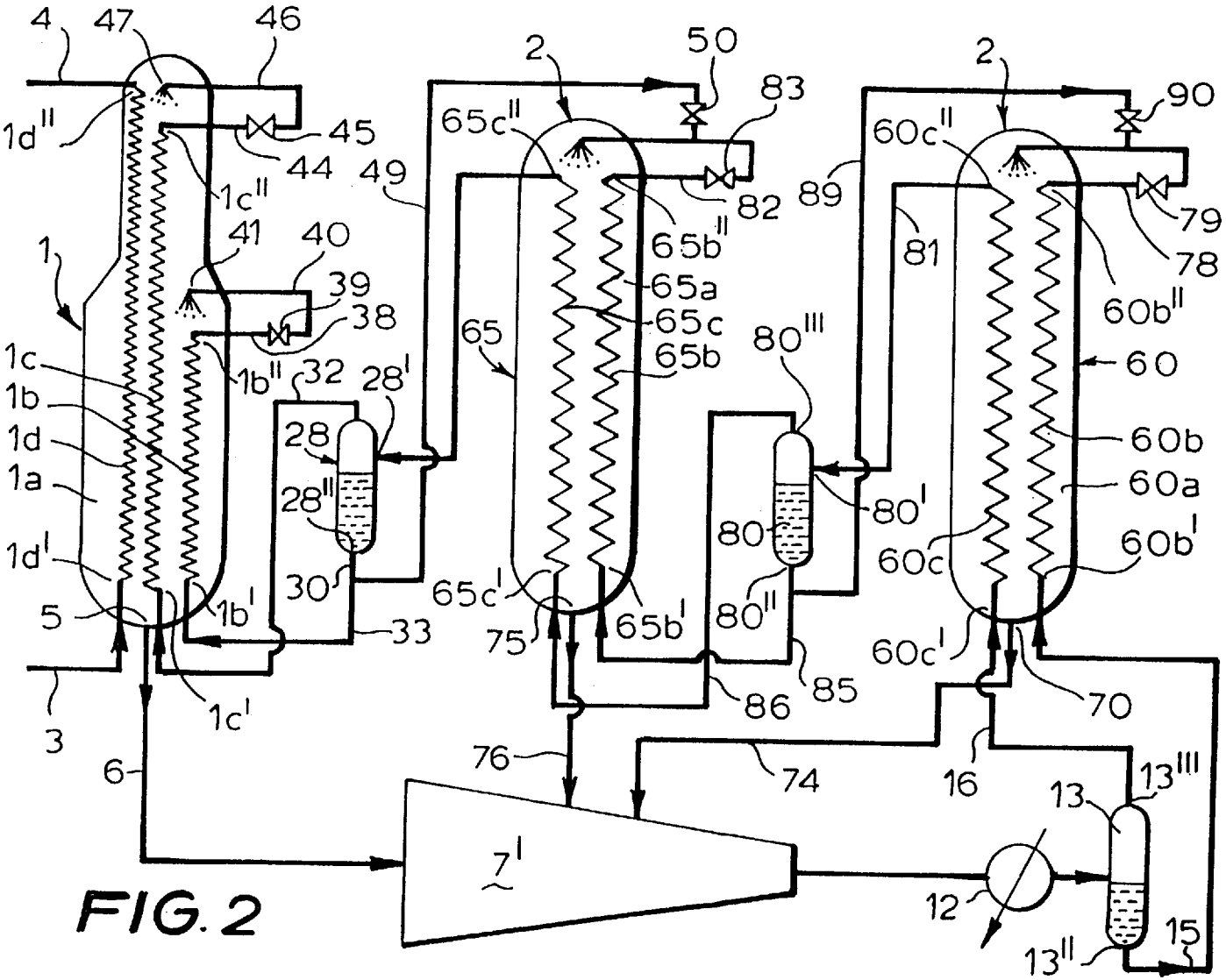

The invention will now be described by way of example in more detail with reference to the accompanying drawings, wherein FIG. 1 shows a schematic flow scheme of the method of the present invention; and FIG. 2 shows an alternative embodiment of the present invention.

Reference is now made to FIG. 1. The method of the present invention is carried out using two heat exchangers, a main heat exchanger 1 and an auxiliary heat exchanger 2. Each heat exchanger comprises a cold side and several hot sides. The cold side of the main heat exchanger 1 is referred to with reference numeral la and the first, second and third hot side of the main heat exchanger are referred to with reference numerals 1*b*, 1*c* and 1*d*. The inlets and outlets of the hot sides are referred to with reference numerals 1*b*' and 1*b*", 1*c*' and 1*c*", and 1*d*' and 1*d*". The cold side of the auxiliary heat exchanger 2 is referred to with reference numeral 2*a* and the first and second hot side of the auxiliary heat exchanger 2 are referred to with reference numerals 2*b* and 2*c*. The inlets and outlets of the hot sides are referred to with reference numerals 2*b*' and 2*b*", and 2*c*' and 2*c*".

The gas to be cooled is supplied to the inlet 1*d*' of the third hot side id of the main heat exchanger though a conduit 3, it passes through the third hot side 1*d*, it is removed from the third hot side id through outlet 1*d*", and it is removed through a conduit 4 for further treatment (not shown). The third hot side 1*d* is cooled by means of cooled refrigerant which evaporates at low pressure in the cold side la of the main heat exchanger 1. In case the gas to be cooled is natural gas which has to be liquefied, the pressure of the gas is in the range of from 2.0 to 6.0 MPa and the temperature of the liquefied natural gas in the conduit 4 is in the range of from −140° to −160° C.

The way in which the refrigerant is cooled will now be described starting from refrigerant removed from the cold side 1*a* of the main heat exchanger 1.

Refrigerant is removed from a bottom outlet 5 of the cold side 1*a* of the main heat exchanger 1 at the low pressure, and is passed through a conduit 6 to a multi-stage compressor unit in the form of two-stage compressor 7. The two-stage compressor 7 comprises an intermediate pressure stage 7*a* and a high pressure stage 7*b*. In this case a two-stage compressor is used, however, each of the stages may include several stages so that the compressor is a multi-stage compressor, wherein the multi-stage compressor comprises an intermediate pressure stage 7*a* to compress fluid from the low pressure to an intermediate pressure and a high pressure stage 7*b* to compress fluid from the intermediate pressure to a high pressure. The outlet of the first compressor 7*a* is connected to the inlet of the second compressor 7*b* by means of a conduit 7*c*. Optionally the two-stage compressor comprises an inter-stage heat exchanger 7*d* to remove the heat of compression between stages. Refrigerant is passed through conduit 6 to the inlet of the intermediate pressure stage, and it is compressed in the two-stage compressor 7 from the low pressure via the intermediate pressure to the high pressure. Refrigerant at high pressure is removed from the second compressor 7*b* through a conduit 10. The low pressure is in the range of from 0.1 to 0.3 MPa, the intermediate pressure is in the range of from 1.5 to 3.0 MPa, and the high pressure is in the range of from 3.0 to 5.0 MPa.

The conduit 10 is provided with a condenser 12. The condenser 12 can be an air cooler or a water cooler. In the condenser 12 so much heat is removed from the high pressure refrigerant that it partly condenses to obtain a first two-phase fluid. The first two-phase fluid is supplied to inlet 13' of a main gas-liquid separator 13. In the main gas-liquid separator 13 the first two-phase fluid is separated into a first condensed fraction and a first gaseous fraction. The first condensed fraction is removed through outlet 13" and it is passed through conduit 15 to the inlet 2*b*' of the first hot side 2*b* of the auxiliary heat exchanger 2, and the first gaseous fraction is removed through outlet 13"' and it is passed through conduit 16 to the inlet 2*c*' of the second hot side 2*c* of the auxiliary heat exchanger 2.

The first condensed fraction is passed through the conduit 15 to the first hot side 2*b* of the auxiliary heat exchanger 2, thereupon the first condensed fraction passes through the first hot side 2*b* to obtain a cooled first condensed fraction, which fraction is at high pressure. The cooled first condensed fraction is removed from the outlet 2*b*" of the first hot side 2*b* of the auxiliary heat exchanger 2 through a conduit 18. The conduit 18 is provided with a pressure reduction device in the form of pressure reduction valve 19 which is so designed that the fluid downstream of the valve 19 is at intermediate pressure (P1). From the pressure reduction valve 19 the cooled first condensed fraction is returned through a conduit 20 provided with a nozzle 21 into the cold side 2*a* of the auxiliary heat exchanger 2. In this way the outlet 2*b*" of the first hot side 2*b* is connected to the cold side 2*a* of the auxiliary heat exchanger 2. In the cold side 2*a* the cooled first condensed fraction evaporates at intermediate pressure (P1) to obtain refrigerant at intermediate pressure (P1). The first condensed fraction in the first hot side 2*b* is cooled by the refrigerant evaporating in the cold side 2*a* at intermediate pressure.

Refrigerant at intermediate pressure (P1) is removed from the cold side 2*a* through a bottom outlet 23. It is passed through a conduit 24 to the inlet of an intermediate stage of the multi-stage compressor unit in the form of the second compressor 7*b* in which it is compressed to the high pressure together with refrigerant at intermediate pressure from the first compressor 7*a*.

So far attention had been paid to the first condensed fraction removed from the main gas-liquid separator 13 through the conduit 15, now reference is made to the first gaseous fraction removed from the main gas-liquid separator 13 through the conduit 16. The first gaseous fraction is cooled in the second hot side 2*c* by refrigerant evaporating in the cold side 2*a* of the auxiliary heat exchanger 2. So much heat is removed that the first gaseous fraction partly condenses to obtain a second two-phase fluid.

The second two-phase fluid is removed from the outlet 2*c*" of the second hot side 2*c* through a conduit 26 which is connected to inlet 28' of a last gas-liquid separator 28. In the last gas-liquid separator 28 the second two-phase fluid is separated into a penultimate condensed fraction and a penultimate gaseous fraction. The penultimate condensed fraction is removed through outlet 28" and it is passed through conduit 30, and the penultimate gaseous fraction is removed through outlet 28"' and it is passed through conduit 32 to the inlet 1*c*' of the second hot side 1*c* of the auxiliary heat exchanger 1.

Only part of the penultimate condensed fraction is supplied to the main heat exchanger 1, and this is done to reduce the amount of heavier hydrocarbons that eventually have to be evaporated in the main heat exchanger 1. Hereinbelow attention is first paid to the streams supplied to the main heat exchanger 1, thereafter handling the remainder of the second condensed fraction is discussed.

Part of the penultimate condensed fraction is passed through a conduit 33 to the inlet 1*b*' of the first hot side 1*b* of the main heat exchanger 1. In the first hot side 1*b* of the main heat exchanger 1 this penultimate condensed fraction is cooled to obtain a cooled penultimate condensed fraction, which fraction is at high pressure. The cooled penultimate condensed fraction is removed from the outlet 1*b*" of the first hot side 1*b* of the main heat exchanger 1 through a conduit 38. The conduit 38 is provided with a pressure reduction device in the form of pressure reduction valve 39 which is so designed that the fluid downstream of the valve 39 is at the low pressure. From the pressure reduction valve 39 the cooled penultimate condensed fraction is returned through a conduit 40 provided with a nozzle 41 into the cold side la of the main heat exchanger 1. In this way the outlet 1*b*" of the first hot side 1*b* is connected to the cold side 1*a* of the main heat exchanger 1. In the cold side 1*a* the cooled penultimate condensed fraction evaporates at the low pressure to obtain refrigerant at the low pressure. The second penultimate fraction in the first hot side 1*b* is cooled by the refrigerant evaporating in the cold side 1*a* at the low pressure. The refrigerant is subsequently passed to the inlet of the first compressor 7*a* of the two-stage compressor 7.

Now reference is made to the penultimate gaseous fraction removed from the last gas-liquid separator 28 through conduit 32. The penultimate gaseous fraction is cooled in the second hot side 1*c* of the main heat exchanger 1 to obtain a cooled last condensed fraction. The cooled last condensed fraction is removed from the outlet 1*c*" of the second hot side 1*c* of the main heat exchanger 1 through a conduit 44. The conduit 44 is provided with a pressure reduction device in the form of pressure reduction valve 45 which is so designed that the fluid downstream of the valve 45 is at the low pressure. From the pressure reduction valve 45 the cooled last condensed fraction is returned through a conduit 46 provided with a nozzle 47 into the cold side 1*a* of the main heat exchanger 1. In this way the outlet 1*c*" of the second hot side 1*c* is connected to the cold side 1*a* of the main heat exchanger 1. In the cold side la the cooled last condensed fraction evaporates at the low pressure to obtain refrigerant at the low pressure. The refrigerant is subsequently passed to the inlet of the first compressor 7*a* of the two-stage compressor 7.

The cold side 1*a* of the main heat exchanger is filled with evaporating refrigerant obtained from the cooled penultimate and last condensed fractions, this evaporating refrigerant cools the fluids in the hot sides 1*b*, 1*c* and 1*d* of the main heat exchanger 1. The refrigerant at the low pressure is removed from the cold side 1*a* through the bottom outlet 5. It is passed through the conduit 6 to the inlet of the first compressor 7*a* in which it is compressed to the intermediate pressure. Through the conduit 7*c* it is passed to the second compressor 7*b* in which it is compressed with the refrigerant from the auxiliary heat exchanger 2 to the high pressure.

In the process of the present invention only part of the penultimate condensed fraction is passed through conduit 33 to the main heat exchanger 1. The remaining part of the penultimate condensed fraction is passed from the last gas-liquid separator 28 through a conduit 49 to the auxiliary heat exchanger 2. The conduit 49 is provided with a pressure reduction valve 50 which is so designed that the fluid downstream of the valve 50 is at the intermediate pressure. The outlet of the pressure reduction valve 50 communicates with the cold side 2*a* of the auxiliary heat exchanger 2. In this way the outlet 28" of the last gas-liquid separator 28 is also connected to the cold side 2*a* of the auxiliary heat exchanger 2. In the cold side 2*a* the remaining part of the penultimate condensed fraction is allowed to evaporate at the intermediate pressure. For the sake of clarity the pumps and valves required to deliver the required amount of liquid through conduit 49 have not been shown.

The following example illustrates the effect of the present invention in cooling and liquefying natural gas. The composition of the natural gas is nitrogen 3 %vol, methane 86 %vol, ethane 6 %vol and heavier hydrocarbons form the balance. A stream of 100 kg natural gas per second is liquefied, the temperature of the stream in conduit 3 is −32 ° C., its pressure is 5.0 MPa and the temperature of the stream leaving the main heat exchanger through conduit 4 is −152 ° C. The natural gas is cooled and liquefied by a refrigerant comprising nitrogen about 2 %vol, $C_4^+$ up to 25 %vol, and $C_1$–$C_3$ form the balance. The flow rate of the refrigerant in conduit 10 is 700 kg/s at a pressure of 4.4 MPa. The intermediate pressure in the auxiliary heat exchanger is 2.0 MPa.

In method according to the prior art, wherein all second condensed fraction is passed to the main heat exchanger through the conduit 33, the pressure in the cold side 1*a* of the main heat exchanger has to be maintained at about 0.1 MPa. If, according to the invention, part of the second condensed fraction is supplied to the main heat exchanger 1 and the remainder to the auxiliary heat exchanger 2, the pressure in the cold side 1*a* of the main heat exchanger 1 can be maintained at a higher level: in case 20% by mass of the penultimate condensed fraction is passed through conduit 49 to the cold side 2*a* of the auxiliary heat exchanger 2, the pressure in the cold side of the main heat exchanger is about 0.2 MPa. In the method of the invention the low pressure is less low than the low pressure in the known method, and thus in the method of the invention less energy is required to compress the refrigerant.

For the same amount of energy the circulation rate of the refrigerant can be increased and consequently more natural gas can be liquefied. For the conditions of the above example, application of the method of the invention gives an increase in production of about 5 %vol.

Compared with the modified prior art process, the process of the present invention will provide a production increase of about 3 %vol.

The two-stage compressor unit 7 as discussed with reference to FIG. 1 consists of a single compressor for each stage. In an alternative embodiment, a multi-stage compressor can be used wherein the stages are included in one single housing. The latter kind of compressor is referred to with reference numeral 7' in FIG. 2.

FIG. 2 shows an alternative embodiment of the present invention. Parts which are identical to parts shown in FIG. 1 will get the same reference numeral and they will not be discussed in detail.

In the embodiment shown in FIG. 2, the auxiliary heat exchanger 2 comprises a first auxiliary heat exchanger 60 and a second auxiliary heat exchanger 65. The first auxiliary heat exchanger 60 is provided with a cold side 60*a* and with two hot sides, 60*b* and 60*c*, and the second auxiliary heat exchanger 65 is provided with a cold side 65*a* and two hot sides 65*b* and 65*c*. The outlet 70 of the cold side 60*a* of the first auxiliary heat exchanger 60 is connected by means of conduit 74 to the inlet of the last stage of the multi-stage compressor 7'. The outlet 75 of the cold side 65*a* of the second auxiliary heat exchanger 65 is connected by means of conduit 76 to the inlet of an intermediate, lower-pressure stage of the multi-stage compressor 7'.

The outlet 13" for liquid of the main gas-liquid separator 13 is connected by means of conduit 15 to the inlet 60*b*' of the first hot side 60*b* of the first auxiliary heat exchanger 60, and the outlet 13"' for gas is connected by means of conduit 16 to the inlet 60*c*' of the second hot side 60*c*.

The outlet 60*b*" of the first hot side 60*b* of the first auxiliary heat exchanger 60 is connected to the cold side 60*a* by means of a conduit 78 provided with a pressure reduction device 79. The outlet 60*c*" of the second hot side 60*c* is connected to the inlet 80' of a first gas-liquid separator 80 by means of conduit 81.

The outlet 80" for liquid of the first gas-liquid separator 80 is connected by means of a conduit 85 to the inlet 65*b*' of the first hot side 65*b* of the second auxiliary heat exchanger 65, and the outlet for gas 80"' is connected by means of a conduit 86 to the inlet 65*c*' of the second hot side 65.

The outlet 65*b*" of the first hot side 65*b* of the second auxiliary heat exchanger 65 is connected to the cold side 65*a* by means of a conduit 82 provided with a pressure reduction device 83. The outlet 65*c*" of the second hot side 65*c* is connected to the inlet of a second gas-liquid separator. In this case the second gas-liquid separator is the last gas-liquid separator 28.

The outlets 80" and 28" of the first and last gas-liquid separators 80 and 28 are also connected to the cold sides 60*a* and 65*a* of the first and second auxiliary heat exchangers 60 and 65 by means of conduits 89 and 49 each provided with a pressure reduction device 90 and 50 respectively.

During normal operation, the first condensed fraction from the main gas-liquid separator 13 is cooled in the first hot side 60*b* of the first auxiliary heat exchanger 60 to obtain a cooled first condensed fraction, which is allowed to evaporate at an intermediate pressure (P1) in the cold side 60*a* of the first auxiliary heat exchanger 60 to obtain refrigerant at the intermediate pressure ($P_1$) which is subsequently supplied through conduit 74 to the inlet of an intermediate stage of the multi-stage compressor unit 7'. The first gaseous fraction from the main gas-liquid separator 13 is partly condensed in the second hot side 60*c* of the auxiliary heat exchanger 60 to obtain a second two-phase fluid.

The second two-phase fluid is separated in the second gas-liquid separator 80 into a second condensed fraction and a second gaseous fraction. Part of the second condensed fraction is cooled in the first hot side 65*b* of the second auxiliary heat exchanger 65 to obtain a cooled second condensed fraction, which is allowed to evaporate at a second, lower intermediate pressure (P2) in the cold side 65*a* of the second auxiliary heat exchanger 65 to obtain refrigerant at the second intermediate pressure (P2) which is subsequently supplied to the inlet of an intermediate, lower-pressure stage of the multi-stage compressor unit 7'.

The second gaseous fraction is partly condensed in the second hot side 65*c* of the second auxiliary heat exchanger 65 to obtain a third two-phase fluid. In the last gas-liquid separator 28 the third two-phase fluid is separated into the penultimate condensed fraction and the penultimate gaseous fraction. The penultimate fractions are passed to the main heat exchanger 1 in the way as described with reference to FIG. 1.

The remainder of the second condensed fraction is allowed to evaporate at the intermediate pressure (P1) in the cold side 60*a* of the first auxiliary heat exchanger 60, and the remainder of the penultimate condensed fraction is allowed to evaporate at a lower intermediate pressure (P2) in the cold side of an upstream auxiliary heat exchanger, which upstream auxiliary heat exchanger is located upstream of the last gas-liquid separator 28. In this case the upstream auxiliary heat exchanger is the second auxiliary heat exchanger 65.

Comparing the embodiment described with reference to FIG. 1 with this embodiment, it is clear that separating the second two-phase fraction into a penultimate condensed fraction and a penultimate gaseous fraction is now done by further cooling part of the second condensed fraction in the second auxiliary heat exchanger 65 before it is separated to obtain the penultimate fractions. An advantage of the embodiment of FIG. 2 is that the penultimate fractions are lighter.

In stead of two auxiliary heat exchangers, three or more may be used in the same way.

The amount of second condensed fraction which is allowed to evaporate at intermediate pressure (P1) in the cold side of the auxiliary heat exchanger is between 5 and 50% by mass of the second condensed fraction. The amount of penultimate condensed fraction which is allowed to evaporate at an intermediate pressure in the cold side of an upstream auxiliary heat exchanger is between 5 and 50% by mass of the second condensed fraction.

Suitably part of the penultimate condensed fraction is allowed to evaporate at the second, lower intermediate pressure (P2) in the cold side of the second auxiliary heat exchanger.

In an alternative embodiment the natural gas stream supplied through conduit 3 can be pre-cooled in a hot side (not shown) arranged in the auxiliary heat exchanger 2.

In the apparatus as described with reference to FIG. 1, the pressure reduction devices are pressure reduction valves. One or more than one of these pressure reduction valves can be replaced by expansion engines such as turbines.

In an alternative embodiment the two-stage compressor unit may consist of two-stage compressors in parallel, for example between two and four. In this parallel arrangement (not shown) the inlets of the compressors of each stage are joined at a common point, and so are the outlets. An advantage of this arrangement is that the power the compressor unit can deliver can be more closely matched to the required power. A further advantage is that a failure in one of the compressors does not stop the operation of the whole LNG plant.

We claim:

1. A method of cooling a fluid stream which passes through a hot side of a main heat exchanger, which method comprises the steps of:

(a) removing a refrigerant from a cold side of the main heat exchanger;

(b) compressing the refrigerant in a multistage compressor unit from a low pressure via at least one intermediate pressure to a high pressure to obtain a refrigerant at high pressure;

(c) partly condensing the refrigerant obtained in step (b) to obtain a first two-phase fluid, and separating the first two-phase fluid into a first condensed fraction and a first gaseous fraction;

(d) cooling the first condensed fraction in a first hot side of an auxiliary heat exchanger to obtain a cooled first condensed fraction;

(e) allowing the cooled first condensed fraction to evaporate at an intermediate pressure in a cold side of the auxiliary heat exchanger to obtain a refrigerant at the intermediate pressure which is subsequently supplied to an inlet of an intermediate stage of the multi-stage compressor unit;

(f) partly condensing the first gaseous fraction in a second hot side of the auxiliary heat exchanger to obtain a second two-phase fluid;

(g) separating the second two-phase fluid into a penultimate condensed fraction and a penultimate gaseous fraction;

(h) cooling the penultimate condensed fraction in a first hot side of the main heat exchanger to obtain a cooled penultimate condensed fraction;

(i) allowing the cooled penultimate condensed fraction to evaporate at low pressure in the cold side of the main heat exchanger to obtain a refrigerant at low pressure which is subsequently supplied to an inlet of a first stage of the multi-stage compressor unit;

(j) cooling the penultimate gaseous fraction in a second hot side of the main heat exchanger to obtain a cooled last condensed fraction; and (k) allowing the cooled last condensed fraction to evaporate at low pressure in the cold side of the main heat exchanger to obtain refrigerant at low pressure which is subsequently supplied to the inlet of the first stage of the multi-stage compressor unit;

wherein part of the penultimate condensed fraction obtained in step (g) is allowed to evaporate at the intermediate pressure in the cold side of the auxiliary heat exchanger.

2. A method according to claim 1, wherein the amount of the penultimate condensed fraction obtained in step (g) which is allowed to evaporate at the intermediate pressure in the cold side of the auxiliary heat exchanger is between 5 and 50% by mass of the penultimate condensed fraction.

3. A method according to claim 1, wherein step (g) comprises separating the second two-phase fluid into a second condensed fraction and a second gaseous fraction;

cooling the second condensed fraction in a first hot side of a second auxiliary heat exchanger to obtain a cooled second condensed fraction;

allowing the cooled second condensed fraction to evaporate at a second, lower intermediate pressure in a cold side of the second auxiliary heat exchanger to obtain a refrigerant at the second intermediate pressure which is subsequently supplied to an inlet of an intermediate, lower-pressure stage of the multi-stage compressor unit;

partly condensing the second gaseous fraction in a second hot side of the second auxiliary heat exchanger to obtain a third two-phase fluid; and separating the third two-phase fluid into the penultimate condensed fraction and the penultimate gaseous fraction, wherein part of the second condensed fraction is allowed to evaporate at the intermediate pressure in a cold side of a first auxiliary heat exchanger, and wherein part of the penultimate condensed fraction is allowed to evaporate at an intermediate pressure in the cold side of the first or second auxiliary heat exchanger.

4. A method according to claim 3, wherein the amount of the second condensed fraction which is allowed to evaporate at intermediate pressure in the cold side of the first auxiliary heat exchanger is between 5 and 50% by mass of the second condensed fraction.

5. A method according to claim 3, wherein the amount of the penultimate condensed fraction which is allowed to evaporate at an intermediate pressure in the cold side of the first or second auxiliary heat exchanger is between 5 and 50% by mass of the second condensed fraction.

6. A method according to claim 3, wherein part of the penultimate condensed fraction is allowed to evaporate at the second, lower intermediate pressure in the cold side of the second auxiliary heat exchanger.

7. A method according to claim 3, wherein part of the penultimate condensed fraction is allowed to evaporate at the intermediate pressure in the cold side of the first auxiliary heat exchanger.

8. A method according to claim 1, wherein the fluid stream is pre-cooled in a hot side of the auxiliary heat exchanger, and subsequently passed to the hot side of the main heat exchanger.

9. A method according to claim 3, wherein the fluid stream is pre-cooled in a hot side of the first or second auxiliary heat exchanger, and subsequently passed to the hot side of the main heat exchanger.

10. An apparatus for cooling a fluid stream comprising:

a main heat exchanger provided with a cold side having an inlet and an outlet, and at least one hot side through which the fluid stream to be cooled can be passed, each at least one hot side having an inlet and an outlet;

an auxiliary heat exchanger provided with a cold side having an inlet and an outlet, and at least two hot sides each having an inlet and an outlet;

a multi-stage compressor unit provided with a first stage having an inlet and an outlet, an intermediate pressure stage having an inlet and an outlet, and a last stage having an inlet and an outlet, the outlet of the cold side of the main heat exchanger being connected to the inlet of the first stage and the outlet of the cold side of the auxiliary heat exchanger being connected to the inlet of the intermediate pressure stage;

a main gas-liquid separator having an inlet, an outlet for liquid, and an outlet for vapour, of which the inlet is connected to a condenser connected to the outlet of the last stage of the multi-stage compressor unit, of which the outlet for liquid is connected to the inlet of a first hot side of the auxiliary heat exchanger and of which the outlet for vapour is connected to the inlet of a second hot side of the auxiliary heat exchanger;

a last gas-liquid separator having an inlet, an outlet for liquid and an outlet for vapour, of which the inlet is connected to the outlet of the second hot side of the auxiliary heat exchanger, of which the outlet for liquid is connected to the inlet of a first hot side of the main heat exchanger and of which the outlet for vapour is connected to the inlet of a second hot side of the main heat exchanger;

wherein the outlet of the first hot side of the auxiliary heat exchanger is connected to the cold side of the auxiliary heat exchanger by means of a conduit provided with a pressure reduction device;

wherein outlets of the first hot side and the second hot side of the main heat exchanger are connected to the cold side of the main heat exchanger by means of a conduit provided with a pressure reduction device; and wherein the outlet for liquid of the last gas-liquid separator is also connected to the cold side of the auxiliary heat exchanger by means of a conduit provided with a pressure reduction device.

11. An apparatus according to claim 10, wherein the multi-stage compressor unit comprises two-stage compressors arranged in parallel.

12. An apparatus according to claim 11, wherein the number of parallel multistage compressors is two to four.

13. An apparatus according to claim 10, wherein any one of the main and auxiliary heat exchangers consists of two or more units in parallel.

14. An apparatus according to claim 10, wherein the auxiliary heat exchanger includes a hot side for pre-cooling the fluid stream, of which the outlet is connected to the inlet of the hot side of the main heat exchanger.

15. An apparatus according to claim 10 wherein the auxiliary heat exchanger comprises at least a first and a second auxiliary heat exchanger each provided with a cold side having an inlet and an outlet, and two hot sides each having an inlet and an outlet;

wherein the outlet of the cold side of the first auxiliary heat exchanger is connected to the inlet of the last stage of the multi-stage compressor unit, the outlet of the cold side of the second auxiliary heat exchanger is connected to the inlet of the intermediate pressure stage of the multi-stage compressor unit, and so on;

wherein the outlet for liquid of the main gas-liquid separator is connected to the inlet of the first hot side of the first auxiliary heat exchanger and the outlet for gas is connected to the inlet of the second hot side;

wherein the outlet of the first hot side of the first auxiliary heat exchanger is connected to the cold side by means of a conduit provided with a pressure reduction device;

wherein the outlet of the second hot side of the first auxiliary heat exchanger is connected to an inlet of a first gas-liquid separator;

wherein an outlet for liquid of the first gas-liquid separator is connected to the inlet of the first hot side of the second auxiliary heat exchanger and an outlet for gas of the first gas-liquid separator is connected to the inlet of the second hot side of the second auxiliary heat exchanger;

wherein the outlet of the first hot side of the second auxiliary heat exchanger is connected to the cold side by means of a conduit provided with a pressure reduction device;

wherein the outlet of the second hot side is connected to an inlet of a second gas-liquid separator, and so on; and wherein outlets of the first and second gas-liquid separators are also connected to the cold sides of the first and second auxiliary heat exchangers by means of conduits provided with pressure reduction devices.

16. An apparatus according to claim 15, wherein the multi-stage compressor unit comprises two-stage compressors arranged in parallel.

17. An apparatus according to claim 16, wherein the number of parallel multistage compressors is two to four.

18. An apparatus according to claim 15, wherein any one of the main and auxiliary heat exchangers consists of two or more units in parallel.

19. An apparatus according to claim 15, wherein any one of the main and auxiliary heat exchangers consists of two or more units in parallel.

* * * * *